United States Patent [19]

Dibrell et al.

[11] Patent Number: 4,586,426

[45] Date of Patent: May 6, 1986

[54] MULTI-CYLINDER PISTON ENGINE AND METHOD OF OPERATION THEREOF

[75] Inventors: Edwin W. Dibrell; Glenn B. O'Neal; Wilbur A. Schaich, all of San Antonio, Tex.

[73] Assignee: Centrifugal Piston Expander, Inc., San Antonio, Tex.

[21] Appl. No.: 617,288

[22] Filed: Jun. 4, 1984

[51] Int. Cl.[4] ..... F01B 13/04; F01L 23/00

[52] U.S. Cl. ..... 91/176; 91/197; 91/273; 91/398; 91/410

[58] Field of Search ..... 91/176, 196, 197, 210, 91/216 R, 216 A, 216 B, 217, 272, 273, 325, 339, 395, 397, 398, 410; 92/66, 68, 120, 147; 123/18 R, 18 A, 43 R, 43 B, 46 R

[56] References Cited

U.S. PATENT DOCUMENTS

| | | | |
|---|---|---|---|
| 668,822 | 2/1901 | MacLaury | 92/66 X |
| 1,158,238 | 10/1915 | Knowles | 91/176 |
| 2,691,965 | 10/1954 | Honegger | 91/273 X |
| 2,982,261 | 5/1961 | McClintock | 123/43 R X |
| 3,702,746 | 11/1972 | Parmerlee | 123/18 R X |

FOREIGN PATENT DOCUMENTS

| | | | |
|---|---|---|---|
| 676797 | 6/1939 | Fed. Rep. of Germany | 91/410 |

*Primary Examiner*—Michael Koczo
*Attorney, Agent, or Firm*—Norvell & Associates

[57] ABSTRACT

Apparatus for producing a reciprocating oscillation of a power output shaft comprises a plurality of peripherally spaced cylinders disposed in generally tangential relationship to the periphery of a cylindrical fluid pressure chamber and connected at their inner ends to such fluid pressure chamber. The gas pressure in such chamber is regulated to maintain a selected value above ambient. Cooperating pistons in each of the cylinders are interconnected by connecting rods to a spoke-like rocker element which is freely oscillatable about the output shaft to which the housing defining the cylindrical fluid pressure chamber is secured for co-rotation. A flywheel mass is connected to the spokes of the rocker element. Inlet and exhaust valves are provided in a cylinder head mounted in the outer end of each cylinder and are operable by contact with the outer face of the respective piston. A radial exhaust port is uncovered by each piston as it nears the end of its power stroke, thus reducing the fluid pressure on the outer piston face to ambient and permitting the regulated fluid pressure chamber to effect the return of the pistons to their outermost pistons relative to the cylinder.

24 Claims, 7 Drawing Figures

MULTI-CYLINDER PISTON ENGINE AND METHOD OF OPERATION THEREOF

BACKGROUND OF THE INVENTION

1. Field of the Invention

The invention relates to a method and apparatus for extracting mechanical energy from a pressured gas by expanding same in a plurality of peripherally spaced cylinders mounted for oscillating movement about the axis of an output shaft which is connected to the cylinders.

2. Description of the Prior Art

In pending patent application Ser. No. 560,305, filed Dec. 12, 1983, now U.S. Pat. No. 4,513,576, and assigned to the Assignee of this application, there is disclosed a plurality of configurations of fluid pressure engines wherein a power output is derived by the oscillating movements of one or more cylinders which are mounted for oscillating movement about an axis defined by an output shaft on which the cylinders are mounted. In all such arrangements, a free piston is employed in each of the cylinders. The opening of inlet valves to add a compressed gas to one end of the cylinder and, in some instances, the concurrent control of exhaust valves at the same and opposite ends of the cylinder was effected by solenoid-actuated valves. Such valves were controlled by electronic sensing devices responsive to the piston positions. Moreover, because none of the pistons were in any manner interconnected, special electronic timing mechanisms had to be incorporated in the valve control circuits to insure that the pistons were substantially concurrently energized during each of their power strokes, so as to maintain dynamic balance of the oscillating frame carrying the cylinders.

Computer modeling of several of the configurations disclosed in the aforementioned co-pending application revealed the fact that under certain assumed conditions, the reciprocating movement of the free pistons occurred at such a high rate as to require extremely fast action of the inlet and exhaust valves.

Lastly, and most importantly, since the oscillatable cylinders were connected to a load, the application of fluid pressure force between the cylinders and the pistons resulted in the pistons having a substantially greater stroke than the cylinders, primarily due to the fact that the total piston mass was significantly less than the total effective mass connected to the cylinders. If, for example, the weight of the free pistons were only one-tenth the effective weight of the load and interconnected cylinders which respectively cooperate with the free pistons, the stroke of the cylinders over any given time period would obviously be only one-tenth the stroke of the pistons in the same time period. Thus, while the interconnected cylinders did produce an oscillating torque about the axis of the output shaft, the stroke of the interconnected cylinders, hence the angular stroke of the oscillation of the output shaft, was quite limited in extent and thus limited the number of potential applications of the fluid pressure operated oscillating engine.

SUMMARY OF THE INVENTION

This invention provides a plurality of peripherally spaced cylinders mounted in generally tangential relationship to the periphery of an enclosed cylindrical fluid pressure chamber which in turn is keyed to an output shaft which is oscillatably supported by suitable bearings. Each of the tangentially disposed cylinders cooperates with a piston which is "free" insofar as it has no connection with the load to be driven by the apparatus but, for convenience in control, such pistons are interconnected by connecting rods to a rocker element mounted for free oscillation about the output shaft. The interconnection of the pistons to the rocker element assures that all of the pistons will move in synchronism and, hence, eliminates the necessity for elaborate electronic control circuitry to insure the synchronous movement of the pistons.

The inner ends of each of the cylinders are in open communication with the cylindrical fluid pressure chamber. The gas pressure within such chamber is regulated to maintain a value that is in excess of atmospheric pressure. As each piston approaches the inner end of its respective cylinder, a radial port in the cylinder is then uncovered by the piston, thus assuring that the outer face of the piston is exposed only to atmospheric or ambient pressure during the most of its return stroke. Thus, the regulated internal pressure of the cylindrical fluid pressure chamber acts on the inner face of each piston to stop its inward movement and relatively move the piston back through the cylinder to the outer end of the cylinder.

Each cylinder is provided with a detachable cylinder head in which are mounted both a fluid pressure inlet valve and an exhaust valve. The fluid pressure inlet valve is connected to a suitable source of pressured gas from which the oscillating power is desired to be derived, and such valve is opened through the contact of a stem portion of a stem valve with the outer face of the piston as the piston approaches the outer end of the respective cylinder. The inlet valve does not, however, remain open, inasmuch as an inlet check valve element is provided to close the fluid inlet passage whenever the internal pressure in the cylinder exceeds the fluid pressure of the incoming gas. Thus, the fluid pressure may be built up within the outer end of the cylinder by the trapping of the gas contained therein between the outer face of the piston and the cylinder head, thus cushioning the outward movement of the piston and bringing it to a gradual stop.

The exhaust valve provided in the aforementioned cylinder head also performs a dual function. During most of the return movement of the piston to the outer end of the cylinder, the exhaust valve is held in an open position by a relatively light spring. An actuator for the exhaust valve projects inwardly into the cylinder so as to be contacted by the outward face of the piston as it nears the outer end of the cylinder. Such actuator effects the closing of the exhaust valve so that the remaining gas in the outer end of the cylinder is trapped and functions as a cushion to stop the outward movement of the piston. The exhaust valve remains closed due to the pressure force thereon as the piston reverses its direction and moves inwardly by the force of the trapped gas until the aforementioned radial port in the cylinder wall is uncovered by the inward movement of the piston, thus resulting in the dropping of the cylinder pressure to atmospheric or ambient and permitting the exhaust valve to be again opened by its relatively light spring.

Since each of the cylinders is disposed in generally tangential relationship to the axis of the oscillatable output shaft, it is apparent that a maximum reaction torque is developed on each of the cylinders. Additionally, the rocker element provided for the piston is constructed in the form of a central hub having a plurality of projecting spokes, which are respectively pivotally connected at their outer ends to the piston connecting rods. An annular flywheel mass of selected weight may then be bolted to the spokes of the rocker element, thus providing a very substantial increase in the total inertial mass of the interconnected pistons without requiring that the mass of the pistons be increased, which would result either in an increase in diameter or length of the cylinders, or a reduction in available stroke length of the pistons within the cylinders. Thus, the total interconnected piston mass may be made substantially greater than the interconnected cylinder mass without increasing the size of the pistons, with the result that the stroke of the interconnected cylinders, hence the stroke of the oscillatable output shaft, will be substantially increased, and the frequency of oscillation will be substantially decreased.

Further objects and advantages of the invention will be readily apparent to those skilled in the art from the following detailed description, taken in conjunction with the annexed sheets of drawings, on which are shown a preferred embodiment of the invention.

DESCRIPTION OF PREFERRED EMBODIMENT

Figure 1:
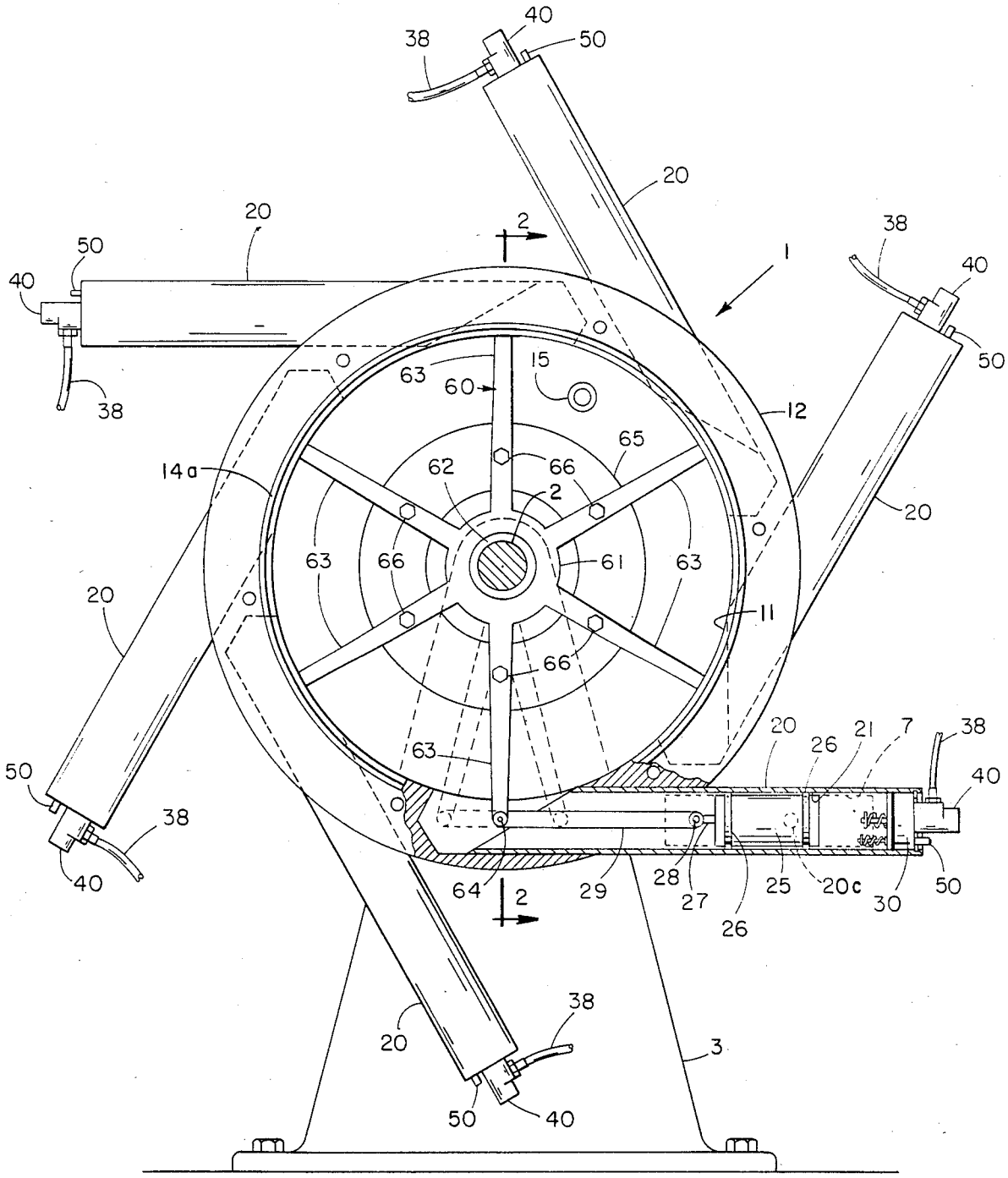
FIG. 1 is an elevational view, partly in section, and with a coverplate removed, of a fluid pressure operated oscillating engine embodying this invention.
Figure 2:
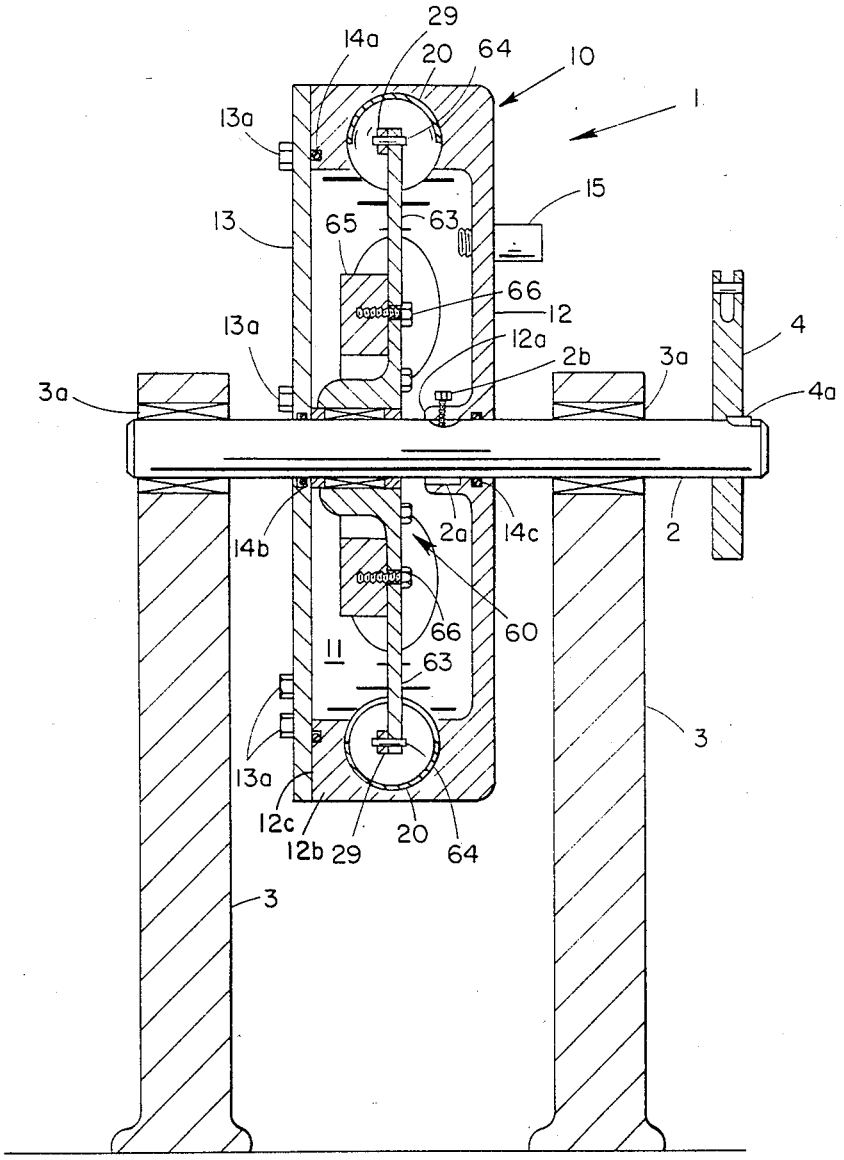
FIG. 2 is a vertical sectional view of the complete engine taken on the plane 2—2 of FIG. 1.

Referring particularly to FIGS. 1 and 2, an apparatus 1 embodying this invention comprises a power output shaft 2 which is supported for oscillatable movements by a pair of laterally spaced bearing pillars 3. Suitable anti-friction bearings 3*a* are provided in the top portions of the bearing pillars 3 to mount the output shaft 2 for oscillatable movements about its axis. On one end of the output shaft 2, a load transfer arm 4 is rigidly secured, as by a key 4*a*. The load transfer arm 4 effects the transmission of the oscillatable power output of the shaft 2 to any suitable load requiring an oscillating or variable stroke reciprocating input; stroke will remain constant with a constant load.

A cylinder mounting housing 10 is supported by output shaft 2 between the bearing pillars 3 and is secured to output shaft 2 for co-rotation by a convenient means, such as the key 2*a*, and locked against axial displacement by set screw 2*b*. Housing 10 defines a generally cylindrical fluid pressure chamber 11 concentrically surrounding the axis of the output shaft 2. The housing 10 may conveniently be formed in two pieces, the one piece 12 being a generally cup-shaped element having a central hub portion 12*a* by which it is mounted on and secured to the shaft 2 for co-rotation. The second piece comprises a circular cover plate 13 having a central opening for receiving the output shaft 2 and being secured to the rim of the annular wall portion 12*a* of the first housing part 12. A plurality of peripherally spaced bolts 13*a* effect such securement and the chamber 11 is sealed by an O-ring 14*a* disposed between the outer periphery of the circular plate 13 and the radial end face 12*c* of the annular wall portion 12*b*. Additionally, an O-ring 14*b* is disposed between the central hole provided in the circular plate 13 and the power output shaft 2 and an O-ring 14*c* is disposed between the power output shaft 2 and the hub portion 12*a* of the cup-shaped element 12 of the housing 10.

A conventional pressure regulator 15 is suitably connected to the housing 10 so as to be in communication with the cylindrical fluid pressure chamber 11 and regulator 15 is connected by a hose to a suitable source of pressured gas, preferably air, and adjusted to maintain a predetermined gas pressure within the cylindrical fluid pressure chamber 11 which at all times is in excess of atmospheric or ambient pressure. The exact requirements for the pressure to be maintained by the pressure regulator 15 will be developed in detail hereinafter.

As best shown in FIG. 1, a plurality of fluid pressure cylinders 20 are rigidly mounted in peripherally spaced relationship to the cylindrical wall portion 12*b* of the housing 10. Each of the cylinders 20 is disposed with its axis in generally tangential relationship to the periphery of the cylindrical fluid pressure chamber 11. Cylinders 20 may be conveniently assembled to the housing 10 by drilling holes through the thickened annular wall 12*b* to snugly accomodate the cylinders 20, and then braising the cylinders in such holes. The inner end of the bore 21 of each cylinder 20 is in fluid communication with the cylinder fluid pressure chamber 11. The outer ends of each cylinder 20 are closed by a cylinder head assemblage 30 containing both an inlet valve 40 and exhaust valve 50, both of which will be described in detail hereinafter.

Within each of the cylinders 20, a piston 25 of conventional cylindrical configuration and carrying a pair of piston rings 26 is slidably mounted for reciprocating movements therein. Each of the pistons 25 has a stem portion 27 defining a pivot bore for receiving a wrist pin 28 which pivotally connects a connecting rod 29 to a rocker element 60.

Rocker element 60 comprises a hub portion 61 which is mounted for free rotation about the output shaft 2 by a suitable anti-friction bearing 62. A plurality of peripherally spaced integral spokes 63 project radially outwardly from hub portion 61 and are respectively pivotally connected by pins 64 to the ends of the connecting rods 29. It is therefore apparent that the pistons 25 are interconnected for concurrent movement, yet the pistons are completely free insofar as the output shaft 2 is concerned and cannot impart any torque whatsoever to the output shaft 2.

The total mass of the pistons 25 may be substantially increased through the bolted addition of an annular flywheel mass 65 of lead or other suitable metal to the rocker element 60. A plurality of bolts 66 can be employed to connect the annular flywheel mass 65 to the spokes 63. In this manner, the total effective inertial mass of the interconnected pistons may be varied widely to greatly exceed the effective inertial mass of the interconnected cylinders 20 and the load to be driven by the output shaft 2.

Referring now particularly to FIGS. 3–7, the outer end of each cylinder 20 is closed by a cylinder head 30 which seats in a counter bore 20*a* in the outer end of the respective cylinder and is secured in the counter bore by a C ring 30*b*. An O-ring seal 30*c* provides the necessary sealing of the mounting of the cylinder head 30 within the respective cylinder 20. Each cylinder head 30 is provided with an axial extension 31 which in turn defines a fluid inlet pressure chamber 32 which communicates with a reduced diameter valve stem mounting bore 33 which in turn is surrounded by a plurality of peripherally spaced inlet passages 34. The inlet passages 34 communicate with the interior of the fluid pressure chamber 21 defined by the respective cylinder unit 20.

Inlet fluid pressure chamber 32 is provided with an internally threaded radial port 35 which receives a suitable coupling for connection to a hose 38 (FIG. 1) which in turn is connected to the source of pressured gas which is to be utilized for operating the engine. The outer end of inlet fluid pressure chamber 32 is closed by a plug 36 which is secured in counter bore 32*c* by a C-ring 36*a* and sealed by an O-ring 36*b*.

The inlet valve 40 comprises a stem-type valve having a head portion 42 which overlies all of the fluid inlet passages 34 and effects a sealing engagement with the inner end wall 32*a* of the fluid pressure inlet chamber 32. Head portion 42 has an integrally formed, solid stem portion 41 projecting into the cylinder chamber 21. The internal end of stem 41 is internally threaded as indicated at 41*a* to receive a bolt 41*b* which mounts a spring seat 43 against the end of the stem portion 41.

Figure 3:
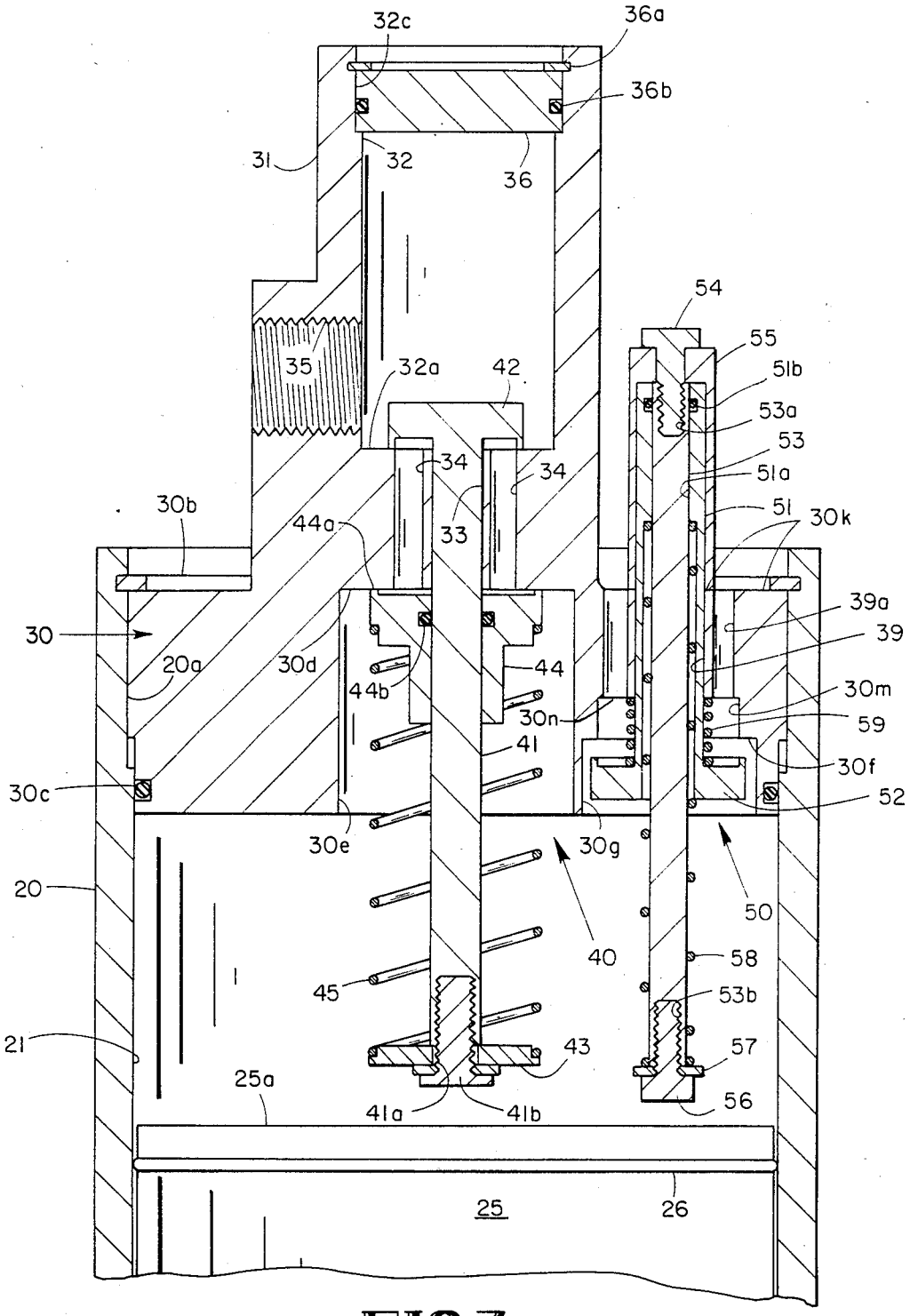
FIG. 3 is an enlarged scale sectional view taken through the axis of the outer end of one of the cylinders of FIG. 1, illustrating the details of the inlet and exhaust valve mechanisms, with said valves being shown in the positions occupied as the piston face approaches the valve-containing end of the cylinder.
Figure 4:
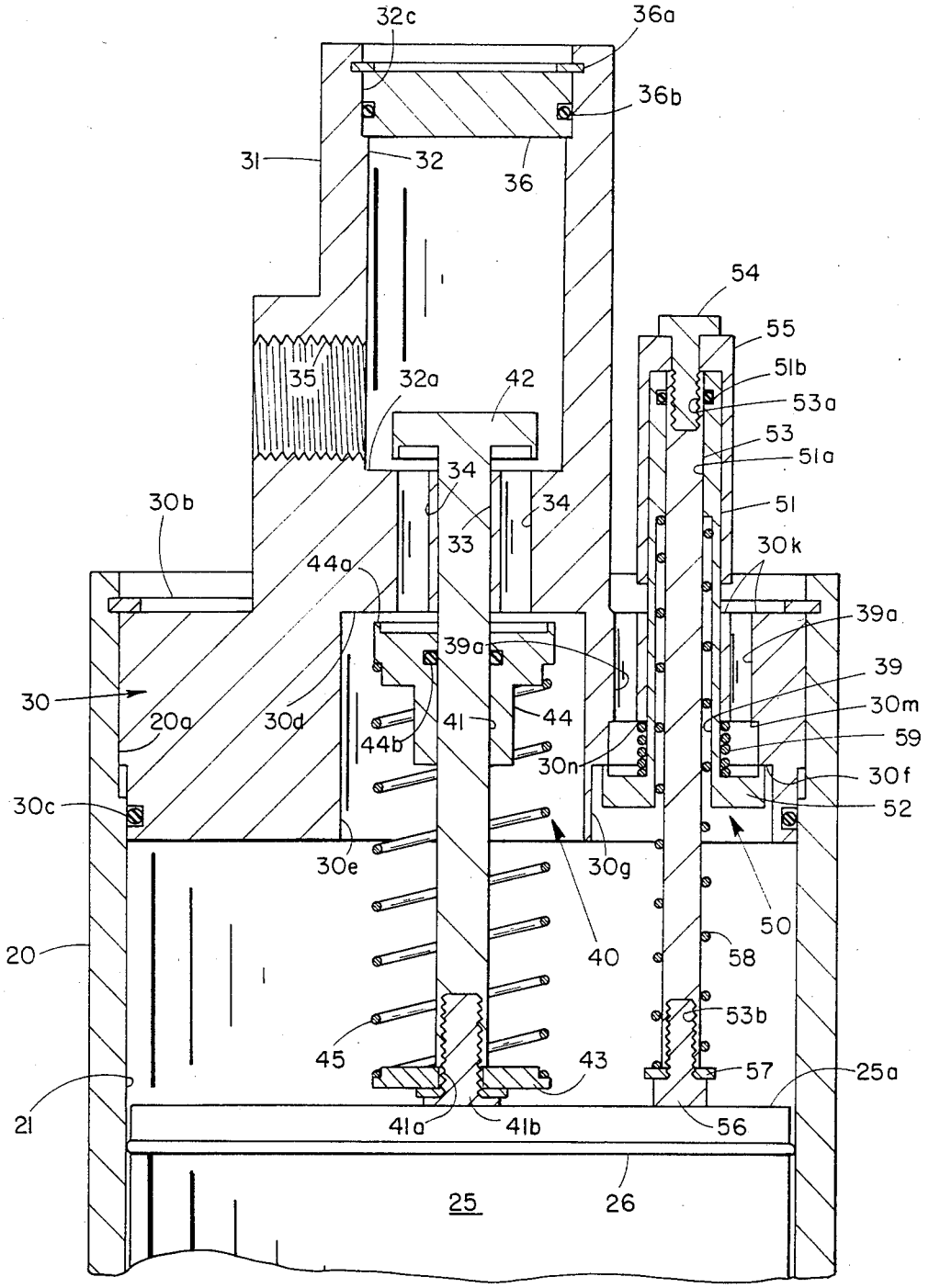
FIG. 4 is a view similar to FIG. 3 but illustrating the position of both the inlet and exhaust valve as the piston contacts stem portions of both valves to open the inlet valve and close the exhaust valve.
Figure 5:
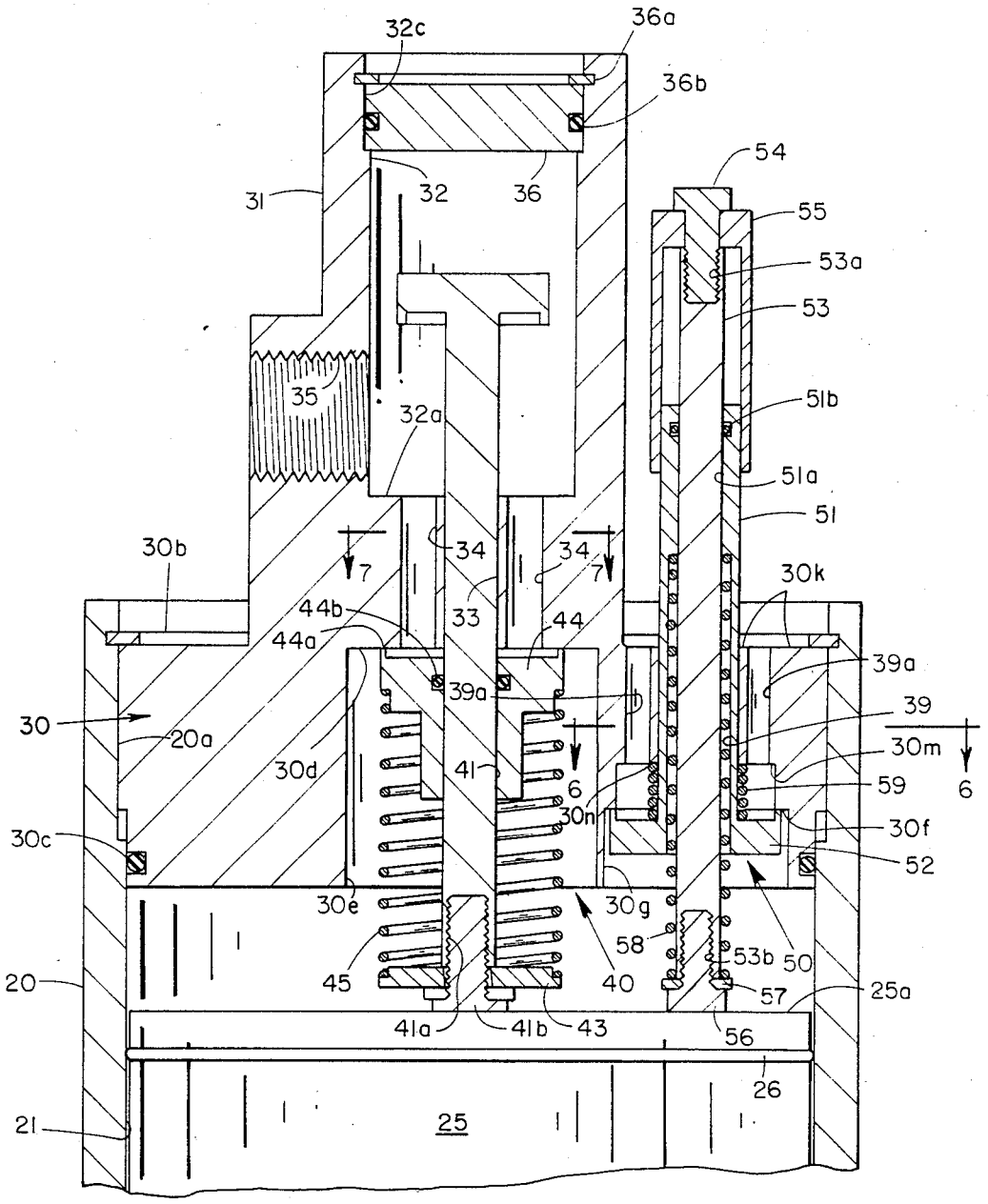
FIG. 5 is a view similar to FIG. 4 but illustrating the closed positions of the inlet and exhaust valves as the piston begins its movement away from the valve-containing end of the cylinder.

An inlet check valve 44 comprises an annular block which is mounted in sliding but sealably relationship on the internal end of stem 41. O-ring 44*b* provides the seal. The inlet valve block 44 is provided with an annular sealing surface 44*a* which overlaps all of the fluid inlet passages 34 and can effect a sealing engagement with the end wall 30*d* of a counter bore 30*e* provided in the inner face of the cylinder head 30. The inlet valve block 44 is urged into sealing engagement with the surface 30*d* by a spring 45 which operates between a peripheral shoulder provided on the inlet valve block 44 and a peripheral shoulder provided on the spring seat 43. Thus, the spring 45 effects a biasing of the inlet valve block 44 into sealing engagement with the inlet ends of the fluid inlet passages 34 and, at the same time, provides a bias urging the stem valve head 42 into sealing engagement with the outer ends of the inlet fluid passages 34. The normal position of inlet valve 40 is closed, as illustrated in FIG. 3, wherein no contact of the inwardly projecting valve stem 41 has been established with the outer face 25*a* of the piston 25. Valve 44 thus functions as a spring-based check valve between cylinder chamber 21 and inlet chamber 32.

Figure 6:
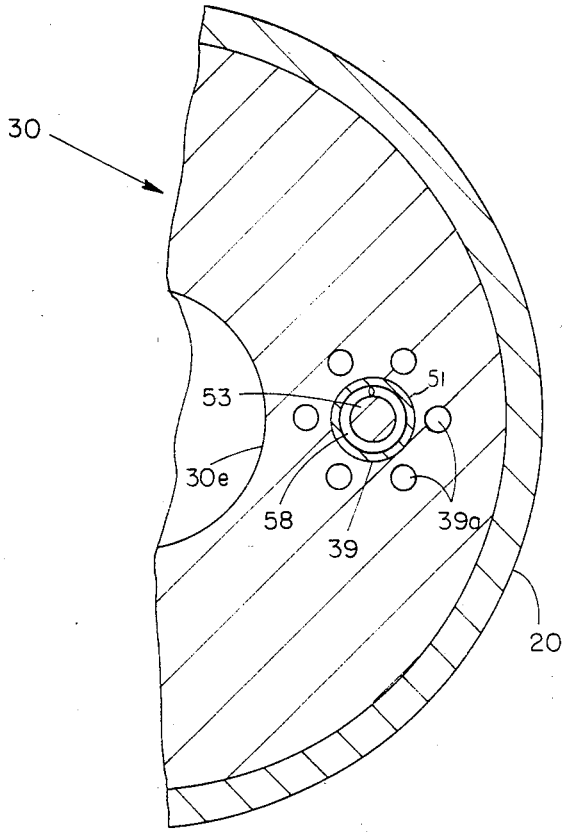
FIG. 6 is a partial sectional view through the cylinder head illustrating the gas exhaust ports.
Figure 7:
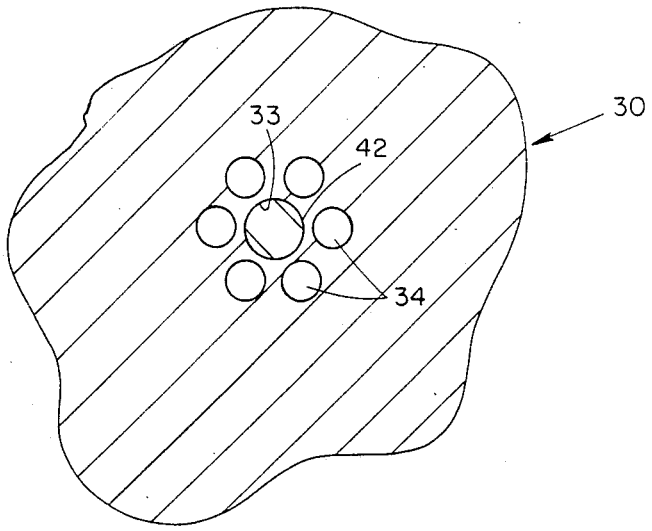
FIG. 7 is a partial sectional view through the cylinder head illustrating the gas inlet ports.

Cylinder head 30 also defines an opening 39 passing entirely through the cylinder head which provides a mounting for the stem portion 51 of an exhaust valve 50. Additionally, a plurality of peripherally spaced exhaust passages 39*a* are provided around the stem opening 39 (FIG. 6).

The exhaust valve 50 is provided with a head portion 52 which overlaps the inner ends of all of the fluid exhaust passages 39*a* and effects a sealing engagement with a radial surface 30*f* formed in the bottom of a counter bore 30*g* which encompasses all of the exhaust fluid passages 39*a*. The stem portion 51 of the exhaust valve 50 is integrally formed with the head portion, is of tubular configuration and extends slidably through the exhaust valve opening 39. Stem portion 51 is provided at its outer end with a reduced diameter internal bore 51*a* providing a mounting for an actuating rod 53. An O-ring 51*b* effects the required seal between the actuating rod 53 and the bore 51*a*.

The outer end portion of the actuating rod 53 is provided with a threaded bore 53*a* for receiving a bolt 54. Bolt 54 secures a positioning collar 55 to the end of the valve stem. Collar 55 has its inner end face abutting the outer face 30*k* of the cylinder head 30. The other end of the actuating rod 53 projects into the cylinder chamber 21 and is also provided with a threaded bore 53*b* and a bolt 56 is mounted in such threaded bore and provides a securement thereto of a spring seat 57. A spring 58 is then mounted between spring seat 57 and the internally projecting shoulder defined between the reduced diameter bore portion 51*a* of the valve stem 51 and the remainder of the hollow exhaust valve stem. Thus, so long as the actuating rod 53 is not shifted by the piston 25, the spring 58 does not maintain the exhaust valve 50 in its closed position. A relatively light spring 59 is provided which operates between the outer face of the head portion 52 of the exhaust valve 50 and the end wall 30*n* of a counter bore 30*m* in the cylinder head 30 to maintain the exhaust valve in its illustrated position in FIG. 3 wherein it is not in sealing engagement with respect to the exhaust fluid passages 39*a*.

The operation of the aforedescribed inlet and exhaust valves as a function of the movement of piston 25 will be readily understood by those skilled in the art. As the piston 25 moves outwardly in the respective cylinder chamber 21 it first engages the bolt 56 and shifts the actuating rod 53 of the exhaust valve outwardly, thus compressing the light spring 59. This forces the exhaust valve 50 to move to its closed position. The inlet valve 40 was already in its closed position and remains in its closed position until the outer face 25*a* of piston 25 contacts the head of bolt 41*b* and displaces the inlet valve 30 in an outward direction, thus opening the inlet fluid passages 34 and permitting pressured gas to supplied to the cylinder chamber 21 from the inlet fluid pressure chamber 32. Such supply of pressured gas continues so long as the fluid pressure on the cylinder side of the cylinder head 30 is less than the fluid pressure in the inlet fluid pressure chamber 32. Whenever the gas pressure in cylinder 21 builds up to a point where it is in excess of the pressure in the fluid inlet chamber 32, then the inlet check valve 44 will be shifted from its open position shown in FIG. 4 to a closed position shown in FIG. 3 and further supply of inlet gas will be cut off. Thus, both the inlet valve 40 and the exhaust valve 50 are in closed positions as the piston 25 nears the outer end of its stroke and the gas trapped between the outer face 25*a* of the piston 25 and the cylinder head 30 will be compressed to a sufficiently high value to insure that the piston will be brought to a cushioned stop and its motion reversed by the compressed gases.

As the piston moves inwardly in the cylinder chamber 21, the exhaust valve 50 remains in its closed position due to the excess of the internal pressure on the inner side of the valve over the ambient pressure existing on the other side of the valve. Similarly, the inlet check valve 44 will remain in its closed position, due to the pressure differential across such valve until the stem portion 41 of the inlet valve 40 has returned to its normal position under the bias of the spring 45, at which point the head 42 of the inlet valve 40 will effect the sealing of the inlet fluid passages 34. During such inward movement of each piston 25, the trapped pressured gas expands and cools, as is well known in the art, thus removing heat energy from the pressured gas.

As the piston 25 approaches the inner end of its inward stroke, it uncovers a radial port 20*c* (FIG. 2) provided in the wall of cylinder 20 and thus permits the dumping of the remaining gas pressure in the cylinder chamber 21 to atmosphere or ambient. Such gas is, of course, expanded and cooled. This permits the exhaust valve 50 to be moved to its open position under the influence of the relatively light spring 59 and the valving system is then ready for another cycle of operations.

From the foregoing description, it will be apparent that the operation of the inlet and exhaust valves is entirely controlled by the position of the respective piston and the action of such valves in moving to the required open or closed position is substantially instantaneous, and hence will not be adversely effected by the speed of reciprocation of the pistons 25. Of equal importance is the fact that all of the pistons 25 are moving concurrently due to their interconnection to the rocker element 60.

By proper selection of the weight of the annular flywheel mass 65, it will be apparent that the effective oscillating stroke of the cylinder elements 20, hence of output shaft 2, may be adjusted to conform to that demand by the particular load. Lastly, the gas pressure maintained within the cylindrical fluid pressure chamber 11 should be selected to insure that the pistons 25 will be stopped in their inward movement by the differential between such gas pressure and atmospheric or ambient pressure which exists on the outer face of each piston 25 as soon as such pistons pass the radial exhaust ports 27. In this manner, there is little danger that the inward motion of the pistons 25 will be abruptly arrested by contact of the rocker spokes 63 or the connecting rods 29 with adjacent elements of the housing 10.

Those skilled in the art will recognize that in the event that the load being driven should encounter an unexpected obstacle such that the load becomes immovable, the reciprocating engine embodying this invention can readily absorb such condition without damage to any of its components. This merely means that the effective mass of the cylinder assemblage becomes infinite and hence all relative movement produced by the supplied gas pressure is performed by movement of the free pistons 25 while the cooperating cylinders 20 remain stationary. Once the load obstacle is removed, the cylinders 20 are free to resume their normal oscillating strokes and, of course, the stroke of the interconnected piston system will be substantially reduced.

If the available pressured gas is air at modest pressures (50–150 psi) then the exhaust valves 50 and exhaust ports 20*c* can vent directly to atmosphere. On the other hand, if the pressure source is gas from a well, and particularly high pressure gas, it would be undesirable to exhaust into the atmosphere. In such cases, the engine 1 may be enclosed to recover the exhaust gas at a suitable ambient level, well above atmospheric pressure, thus permitting further energy extraction from the pressured exhaust gas.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for producing oscillating movement of a power output shaft about its axis comprising, in combination, housing means connected to said shaft defining a generally cylindrical fluid pressure chamber about the shaft axis; a plurality of cylinders secured to said housing means in peripherally spaced relation, each said cylinder having an axis disposed in generally tangential relationship to said cylindrical fluid pressure chamber and an inner end in fluid communication with said fluid pressure chamber; a piston slidably and sealably mounted in each said cylinder for movement between an outer and an inner position relative to said fluid pressure chamber; a rocker element freely rotatable about said shaft axis; connecting rods respectively mounted between said rocker element and said pistons, whereby all said pistons move concurrently relative to said cylinders, input valve means in the outer end of each said cylinder responsive to movement of the respective piston to said outer position to open and close; means for supplying fluid pressure to said input valve means; exhaust valve means on the outer end of each said cylinder responsive to movement of said piston to open and to close; and means for maintaining a fluid pressure in said fluid pressure chamber in excess of the minimum pressure operating on the outer faces of said pistons to return said pistons to said outer position, whereby said housing means and said output shaft are continuously oscillated about said shaft axis.

2. The apparatus of claim 1 further comprising a flywheel mass secured to said rocker element, thereby increasing the angular stroke of said output shaft.

3. The apparatus of claim 1 wherein the total flywheel mass of said rocker element, said connecting rods and said piston substantially exceeds the flywheel mass of said cylinders and housing means, whereby the angular motion of said output shaft in either direction substantially exceeds the concurrent angular motion of said rocker element in the opposite direction.

4. The apparatus of claim 1 wherein said rocker element comprises a hollow hub mounted on said shaft and a plurality of radially projecting, integral spokes respectively pivotally secured to the inner ends of said connecting rods.

5. The apparatus of claim 4 further comprising an annular flywheel detachably secured to said spokes in concentric relation to said shaft axis.

6. The apparatus of claim 1 further comprising a radial exhaust port in each said cylinder traversed by said respective piston as such piston moves from said outer position, thereby reducing the fluid pressure on the outer face of each piston to ambient.

7. The apparatus of claim 1 further comprising a cylinder head sealably mounted on the outer end of each said cylinder; said cylinder head defining a pressure fluid inlet chamber; an axially extending inlet passage extending from said inlet chamber into the interior of said cylinder; an annular valve seat surrounding the outer end of said inlet passage; a stem valve having a head portion sealingly engagable with said valve seat and a stem portion projecting into the interior of said cylinder; resilient means urging said stem valve into sealing engagement with said annular valve seat, whereby movement of said piston toward said outer position is required to engage said stem portion and move said head portion out of sealing engagement with said annular valve seat, thereby permitting flow of pressured fluid into said cylinder.

8. The apparatus of claim 7 further comprising a second annular valve seat surrounding the inner end of said inlet passage; a spring biased check valve engagable with said second annular valve seat but normally biased to an open, non-engaging position, whereby said inlet passage is closed whenever the internal cylinder pressure exceeds the inlet fluid pressure.

9. The apparatus of claim 8 wherein said resilient means comprises a compression spring surrounding said stem portion of said stem valve, an annular shoulder on said stem valve abutting one end of said spring; the other end of said spring abutting said check valve.

10. The apparatus of claim 1 further comprising a cylinder head sealably mounted on the outer end of each said cylinder; said cylinder defining an axially extending exhaust fluid passage from the interior of said cylinder; an annular exhaust valve seat surrounding the inner end of said exhaust fluid passage: a stem-type exhaust valve having a head portion movable outwardly to sealingly engage said annular exhaust valve seat, a hollow stem portion slidably mounted in said cylinder head; an exhaust valve actuator slidably mounted in said hollow stem portion and having an inner end projecting into said cylinder and engagably by said piston; and resilient means urging said exhaust valve to an open position relative to said exhaust valve seat.

11. The apparatus of claim 10 further comprising a spring in said hollow stem portion operatively connecting said exhaust valve actuator and said exhaust valve.

12. Valving apparatus for controlling the gas input to a cylinder having a piston reciprocably mounted therein, comprising a cylinder head sealably mounted on the outer end of said cylinder; said cylinder head defining a pressured gas inlet chamber; and axially extending bore extending from said inlet chamber into the interior of said cylinder; a plurality of axially extending fluid inlet passages peripherally spaced around said bore; and annular valve seat surrounding all of the outer ends of said inlet passages; a stem valve having a head portion sealingly engagable with said valve seat and a stem portion slidable in said bore and projecting into the interior of said cylinder; resilient means urging said stem valve into sealing engagement with said annular valve seat, whereby movement of said piston toward said outer position is required to engage said stem portion and move said head portion out of sealing engagement with said annular valve seat, thereby permitting flow of pressured gas through said fluid inlet passages into said cylinder.

13. Valving apparatus for controlling the gas exhaust from a cylinder having a piston reciprocably mounted therein, comprising a cylinder head sealably mounted on the outer end of said cylinder; said cylinder head defining an axially extending bore communicating with the interior of said cylinder; a plurality of exhaust fluid passages peripherally spaced around said bore; an annular exhaust valve seat surrounding all of the inner ends of said exhaust fluid passage; a stem-type exhaust valve having a head portion movable outwardly to sealingly engage said annular exhaust valve seat and a hollow stem portion slidalby mounted in said bore; resilient means urging said exhaust valve to an open position relative to said exhaust valve seat; and an exhaust valve actuator mounted in said hollow stem portion and operatively connected thereto, said exhaust valve actuator extending into the interior of said cylinder for engagement by said piston during movement of said piston to said outer position to shift said exhaust valve to a closed position in sealing engagement with said exhaust valve seat.

14. The apparatus of claim 13 further comprising a spring in said hollow stem portion operatively connecting said exhaust valve actuator and said exhaust valve.

15. The method of producing an oscillating power output from a source of pressured gas comprising the steps of:

(1) assembling a plurality of cylinders with their axes in generally tangential relationship to a cylindrical fluid pressure chamber defined by a housing mounted for oscillation about the axis of said cylindrical fluid pressure chamber, the inner ends of said cylinders being in fluid communication with said fluid pressure; mounting a piston in each cylinder for reciprocating movements inwardly toward said fluid pressure chamber and outwardly away from said fluid chamber; and interconnecting said pistons for concurrent movement relative to said cylinders;

(2) supplying a pressured gas to said fluid pressure chamber to maintain an above atmosphere pressure in said fluid pressure chamber; and (3) applying a pressured gas concurrently to the outer faces of said pistons at a pressure in excess of said pressure in said fluid pressure chamber, thereby producing relative movement of said cylinders and said pistons in opposite directions about said axis and reducing the fluid pressure on the outer faces of said pistons below said fluid chamber pressure and reversing the direction of relative movement of said cylinders and said pistons to return said pistons to their said outermost positions relative to said cylinders; and (4) connecting one of said housing and said pistons to a reciprocating load.

16. The method of claim 15 further comprising the step of exhausting the fluid pressure on the outer faces of said pistons to a level below said level in the fluid pressure chamber prior to the end of the inward movement of said pistons, whereby the piston momentum is absorbed by said fluid pressure in said fluid pressure chamber.

17. Apparatus for extracting mechanical and heat energy from a pressured gas comprising, in combination: a power output shaft mounted for oscillating movements about it axis; housing means connected to said shaft and defining a generally cylindrical fluid pressure chamber about the shaft axis; a plurality of cylinders secured to said housing means in peripherally spaced relation, each said cylinder having an axis disposed in generally tangential relationship to said cylindrical fluid pressure chamber and an inner end in fluid communication with said fluid pressure chamber; a piston slidably and sealably mounted in each said cylinder for movement between an outer and an inner position relative to said fluid pressure chamber; a rocker element freely rotatable about said shaft axis; connecting rods respectively mounted between said rocker element and said pistons, whereby all said pistons move concurrently relative to said cylinders, input valve means in the outer end of each said cylinder responsive to movement of the respective piston to said outer position to open and close; means for supplying pressured gas to said input valve means; exhaust valve means on the outer end of said cylinder responsive to movement of said piston to open and to close; and means for maintaining a gas pressure in said fluid pressure chamber in excess of the minimum pressure operating on the outer faces of said pistons to return said pistons to said outer positions, whereby said housing means and said output shaft are continuously oscillated about said shaft axis, and means for exhausting the expanded gas in each said cylinder traversed by said respective piston when such piston approaches said inner position, thereby discharging an expanded and cooled gas from each said cylinder.

18. The apparatus of claim 17 further comprising a flywheel mass secured to said rocker element, thereby increasing the angular stroke of said output shaft.

19. The apparatus of claim 17 wherein said rocker element comprises a hollow hub mounted on said shaft and a plurality of radially projecting, integral spokes respectively pivotally secured to the inner ends of said connecting rods.

20. The apparatus of claim 17 further comprising an annular flywheel detachably secured to said spokes in concentric relation to said shaft axis.

21. The method of extracting head and mechanical energy from a pressured gas, comprising the steps of:

(1) assembling a plurality of cylinders with their axis in generally tangential relationship to a cylindrical fluid pressure chamber defined by a housing mounted for oscillation about the axis of said cylindrical fluid pressure chamber, the inner ends of said cylinder being in fluid communication with said fluid pressure chamber; mounting a piston in each cylinder for reciprocating movements inwardly toward said fluid pressure chamber; and interconnecting said pistons for concurrent movement relative to said cylinders;

(2) supplying a pressured gas to said fluid pressure chamber to maintain an above ambient pressure in said fluid pressure chamber; and (3) supplying a pressured gas concurrently to the outer faces of said pistons in excess of said gas pressure in said fluid pressure chamber; thereby producing relative movement of said cylinders and said pistons in opposite directions about said axis and expanding and cooling the pressured gas supplied to the outer faces of said pistons;

(4) discharging the expanded and cooled gas to ambient; and (5) connecting one of said housing and said pistons to a reciprocating load.

22. The method of claim 21 further comprising the step of exhausting the gas pressure on the outer faces of said piston to a level below said above ambient gas pressure in the fluid pressure chamber prior to the end of the inward movement of said pistons, whereby the piston momentum is absorbed by said fluid pressure in said fluid pressure chamber.

23. Valving apparatus for controlling the gas input to a cylinder having a piston reciprocably mounted therein, comprising a cylinder head sealably mounted on the outer end of said cylinder; said cylinder head defining a pressured gas inlet chamber; an axially extending inlet passage extending from said inlet chamber into the interior of said cylinder; an annular valve seat surrounding the outer end of said inlet passage; a stem valve having a head portion sealingly engagable with said valve seat and a stem portion projecting into the interior of said cylinder; resilient means urging said stem valve into sealing engagement with said annular valve seat, whereby movement of said piston toward said cylinder head is required to engage said stem portion and move said head portion of said stem valve out of sealing engagement with said annular valve seat, thereby permitting flow of pressured gas into said cylinder; a second annular valve seat surrounding the inner end of said inlet passage; a spring biased check valve biased into engagement with said second annular valve seat whereby said inlet passage is opened only when said stem valve is shifted by said piston out of engagement with its said annular valve seat and the inlet chamber gas pressure exceeds the cylinder gas pressure.

24. The apparatus of claim 23 wherein said resilient means comprises a compression spring-surrounding said stem portion of said stem valve, an annular shoulder on said stem valve abutting one end of said spring; the other end of said spring abutting said check valve.

* * * * *